US011837792B2

(12) United States Patent
Zhang et al.

(10) Patent No.: US 11,837,792 B2
(45) Date of Patent: Dec. 5, 2023

(54) HIGH-FREQUENCY RADIATOR, MULTI-FREQUENCY ARRAY ANTENNA, AND BASE STATION

(71) Applicant: Huawei Technologies Co., Ltd., Shenzhen (CN)

(72) Inventors: Xiuyin Zhang, Shenzhen (CN); Zhiqiang Liao, Shenzhen (CN); Chengdai Xue, Shenzhen (CN); Yaojiang Zhang, Shenzhen (CN); Yili Xu, Shanghai (CN); Zhihan Chen, Dongguan (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 360 days.

(21) Appl. No.: 17/360,107

(22) Filed: Jun. 28, 2021

(65) Prior Publication Data

US 2021/0328365 A1 Oct. 21, 2021

Related U.S. Application Data

(63) Continuation of application No. PCT/CN2019/128374, filed on Dec. 25, 2019.

(30) Foreign Application Priority Data

Dec. 29, 2018 (CN) ..... 201811640716.2

(51) Int. Cl.
*H01Q 21/24* (2006.01)
*H01Q 21/00* (2006.01)
(Continued)

(52) U.S. Cl.
CPC ..... *H01Q 21/24* (2013.01); *H01Q 21/00* (2013.01); *H01Q 21/0075* (2013.01);
(Continued)

(58) Field of Classification Search
CPC ..... H01Q 1/246; H01Q 5/48; H01Q 19/10; H01Q 5/25; H01Q 9/0407; H01Q 5/392;
(Continued)

(56) References Cited

U.S. PATENT DOCUMENTS 5,532,708 A 7/1996 Krenz et al.
9,698,486 B2 7/2017 Shooshtari et al.
(Continued)

FOREIGN PATENT DOCUMENTS

CN 105281031 A 1/2016
CN 103730728 B 9/2016
(Continued)

OTHER PUBLICATIONS

Liu Y., et al., "A Compact Dual-Band Dual-Polarized Antenna With Filtering Structures for Sub-6 GHz Base Station Applications", IEEE Antennas and Wireless Propagation Letters, vol. 17, No. 10, Oct. 2018, 5 Pages.
(Continued)

*Primary Examiner* — Vibol Tan
(74) *Attorney, Agent, or Firm* — Slater Matsil, LLP

(57) ABSTRACT

Embodiment high-frequency radiator includes two plus and minus 45-degree single-polarized radiators. The single-polarized radiator includes a radiation arm, a balun, a feeder circuit, a filter, and a ground plane. The radiation arm and the balun are electrically connected. The feeder circuit and the balun are separately disposed on two surfaces of a first dielectric plate that is placed vertically. The ground plane is disposed on a downward surface of a second dielectric plate that is placed horizontally. The first dielectric plate is vertically disposed on the second dielectric plate, and the filter includes a capacitor branch and an inductor branch. The inductor branch is disposed on a same surface of the first dielectric plate as the balun, the inductor branch is separately electrically connected to the balun and the ground plane, and the capacitor branch is coupled to the ground plane.

20 Claims, 4 Drawing Sheets

(51) Int. Cl.
*H01Q 21/30* (2006.01)
*H01Q 21/06* (2006.01)
*H01Q 1/48* (2006.01)

(52) U.S. Cl.
CPC ..... *H01Q 21/065* (2013.01); *H01Q 21/30* (2013.01); *H01Q 1/48* (2013.01)

(58) Field of Classification Search
CPC ..... H01Q 5/378; H01Q 5/10; H01Q 21/065; H01Q 21/06; H01Q 21/00; H01Q 21/24; H01Q 21/0075; H01Q 21/30; H01Q 1/48; H01Q 1/521; H01Q 21/26; H01Q 1/523; H01Q 1/50
See application file for complete search history.

(56) References Cited

U.S. PATENT DOCUMENTS

| | | | | |
|---|---|---|---|---|
| 10,446,926 | B2 * | 10/2019 | Xiao | H01Q 21/30 |
| 10,511,088 | B2 * | 12/2019 | Xiao | H01Q 1/48 |
| 10,680,323 | B2 * | 6/2020 | Zhang | H01Q 21/30 |
| 11,296,425 | B2 * | 4/2022 | Zhang | H01Q 15/0013 |
| 11,322,834 | B2 * | 5/2022 | Daojian | H01Q 5/50 |
| 11,394,120 | B2 * | 7/2022 | Zhang | H01Q 1/36 |
| 11,710,908 | B2 * | 7/2023 | Cao | H01Q 1/521 343/702 |
| 2015/0070234 | A1 | 3/2015 | Jones | |
| 2018/0323513 | A1 | 11/2018 | Varnoosfaderani et al. | |
| 2018/0351246 | A1 | 12/2018 | Yu et al. | |

FOREIGN PATENT DOCUMENTS

| | | | |
|---|---|---|---|
| CN | 105960737 | A | 9/2016 |
| CN | 107134639 | A | 9/2017 |
| CN | 107210531 | A | 9/2017 |
| CN | 108963454 | A | 12/2018 |
| WO | 2017035726 | A1 | 3/2017 |
| WO | 2018214427 | A1 | 11/2018 |
| WO | 2018231670 | A2 | 12/2018 |

OTHER PUBLICATIONS

Xue, C., et al., "MIMO Antenna Using Hybrid Electric and Magnetic Coupling for Isolation Enhancement", IEEE Transactions on Antennas and Propagation, vol. 65, No. 10, Oct. 2017, 9 Pages.

* cited by examiner

HIGH-FREQUENCY RADIATOR, MULTI-FREQUENCY ARRAY ANTENNA, AND BASE STATION

CROSS-REFERENCE TO RELATED APPLICATIONS

This application is a continuation of International Application No. PCT/CN2019/128374, filed on Dec. 25, 2019, which claims priority to Chinese Patent Application No. 201811640716.2, filed on Dec. 29, 2018. The disclosures of the aforementioned applications are hereby incorporated by reference in their entireties.

TECHNICAL FIELD

This application relates to antenna technologies, and in particular, to a high-frequency radiator, a multi-frequency array antenna, and a base station.

BACKGROUND

With development of mobile communication systems, base station antennas need to implement multi-frequency and multi-polarization, to meet common requirements of a plurality of operators. However, during implementation, a conventional multi-frequency antenna can meet an indicator requirement only when a width size of the antenna is excessively large. Once the width size decreases, common-mode resonance is generated in a high-frequency radiator when an electromagnetic wave is coupled from a low-frequency radiator to the high-frequency radiator, resulting in significant deterioration of a low-frequency indicator.

Currently, a method for suppressing common-mode resonance at a low operating frequency band in a high-frequency radiator of a multi-frequency antenna is to load a capacitor-inductor-capacitor circuit on a balun of the high-frequency radiator and a dipole arm of the high-frequency radiator, to implement matching at a high frequency band, and move, at the low frequency band, the common-mode resonance of the high-frequency radiator out of the low frequency band.

However, a bandwidth of the multi-frequency antenna is limited, and processing costs are comparatively high.

SUMMARY

This application provides a high-frequency radiator, a multi-frequency array antenna, and a base station, to resolve a problem of common-mode resonance of a high-frequency radiator without affecting a bandwidth of an antenna, thereby featuring low processing costs.

According to a first aspect, this application provides a high-frequency radiator. The high-frequency radiator is a dual-polarized radiator, and the dual-polarized radiator includes two plus and minus 45-degree single-polarized radiators.

The single-polarized radiator includes a radiation arm, a balun, a feeder circuit, a filter, and a ground plane. The radiation arm and the balun are electrically connected. The feeder circuit and the balun are separately disposed on two surfaces of a first dielectric plate that is placed vertically. The ground plane is disposed on a downward surface of a second dielectric plate that is placed horizontally. The first dielectric plate is vertically disposed on the second dielectric plate. The filter includes a capacitor branch and an inductor branch. The inductor branch is disposed on a same surface of the first dielectric plate as the balun. The inductor branch is separately electrically connected to the balun and the ground plane. The capacitor branch is coupled to the ground plane.

The feeder circuit is configured to feed the high-frequency radiator.

The filter is configured to weaken an impact of the high-frequency radiator on a low-frequency radiator, where a highest frequency of an operating frequency band of the low-frequency radiator is lower than a lowest frequency of an operating frequency band of the high-frequency radiator.

In this application, when structures of the radiation arm and the balun of the high-frequency radiator are not affected, the filter is added between the balun and the ground plane, to weaken the impact of the high-frequency radiator on the low-frequency radiator, and implement normal transmission of a signal of the high-frequency radiator. This not only resolves a problem of common-mode resonance of the high-frequency radiator, but also ensures that a bandwidth of an antenna is not affected, and processing costs are low.

In a possible implementation, the capacitor branch is disposed on an upward surface of the second dielectric plate, and the capacitor branch is electrically connected to the balun.

In a possible implementation, the capacitor branch is disposed on a same surface of the first dielectric plate as the balun, and the capacitor branch is electrically connected to the balun.

In a possible implementation, the capacitor branch includes a first capacitor branch and a second capacitor branch, the first capacitor branch is disposed on an upward surface of the second dielectric plate, the second capacitor branch is disposed on a same surface of the first dielectric plate as the balun, the second capacitor branch is electrically connected to the balun, and the first capacitor branch is electrically connected to the second capacitor branch.

In a possible implementation, the capacitor branch includes a first capacitor branch and a second capacitor branch, the first capacitor branch is disposed on an upward surface of the second dielectric plate, the second capacitor branch is disposed on a same surface of the first dielectric plate as the balun, the inductor branch is electrically connected to the second capacitor branch, and the first capacitor branch is electrically connected to the second capacitor branch.

In a possible implementation, the inductor branch is used as the ground plane, the feeder circuit and the inductor branch form a microstrip line structure, and a coaxial line is disposed on the downward surface of the second dielectric plate, where an outer conductor of the coaxial line is electrically connected to the ground plane, and an inner conductor of the coaxial line is electrically connected to the feeder circuit.

In this application using a microstrip line structure, a high-frequency current signal transmitted from the coaxial line flows to the feeder circuit and the balun without loss through the inner conductor by using the microstrip line structure, and the outer conductor and the ground plane are directly electrically connected through welding, which implements a complete feeding system of the entire high-frequency radiator. In addition, a standing wave bandwidth is higher, and there is no signal discontinuity.

In a possible implementation, both the inductor branch and the capacitor branch are metal stub lines, and a contour formed by a metal stub line used as the inductor branch is narrower and longer than a contour formed by a metal stub line used as the capacitor branch.

According to a second aspect, this application provides a multi-frequency array antenna, including an antenna radiator and an antenna reflection plate. The antenna radiator is disposed on the antenna reflection plate. The antenna radiator includes at least one high-frequency radiator and at least one low-frequency radiator. The high-frequency radiator and the low-frequency radiator are arranged crosswise in a horizontal direction. A highest frequency of an operating frequency band of the low-frequency radiator is lower than a lowest frequency of an operating frequency band of the high-frequency radiator. The high-frequency radiator according to any one of the implementations of the first aspect is used as the high-frequency radiator.

According to the multi-frequency array antenna in this application, when structures of the radiation arm and the balun of the high-frequency radiator are not affected, the filter is added between the balun and the ground plane, to weaken an impact of the high-frequency radiator on the low-frequency radiator, and implement normal transmission of a signal of the high-frequency radiator. This not only resolves a problem of common-mode resonance of the high-frequency radiator, but also ensures that a bandwidth of the antenna is not affected, and processing costs are low.

In a possible implementation, a distance between the high-frequency radiator and the low-frequency radiator is less than or equal to 0.4λ, where λ is a wavelength corresponding to a center frequency of the operating frequency band of the low-frequency radiator.

According to a third aspect, this application provides a base station. The base station includes a multi-frequency array antenna, and the antenna according to any one of the implementations of the second aspect is used as the multi-frequency array antenna.

According to the antenna used in the base station in this application, when structures of the radiation arm and the balun of the high-frequency radiator are not affected, the filter is added between the balun and the ground plane, to weaken the impact of the high-frequency radiator on the low-frequency radiator, and implement normal transmission of a signal of the high-frequency radiator. This not only resolves the problem of the common-mode resonance of the high-frequency radiator, but also ensures that the bandwidth of the antenna is not affected, and the processing costs are low.

DETAILED DESCRIPTION OF ILLUSTRATIVE EMBODIMENTS

To make the objectives, technical solutions, and advantages of the embodiments of this application clearer, the following clearly describes the technical solutions in the embodiments of this application with reference to the accompanying drawings in the embodiments of this application. It is clear that the described embodiments are merely a part rather than all of the embodiments of this application. All other embodiments obtained by a person of ordinary skill in the art based on the embodiments of this application without creative efforts shall fall within the protection scope of this application.

Figure 1:
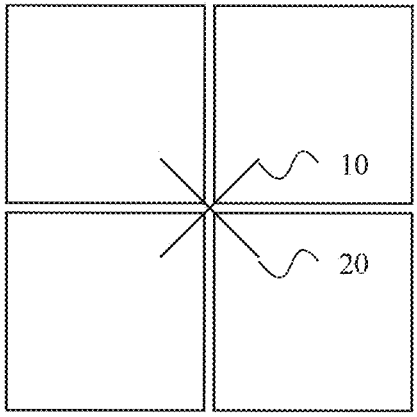
FIG. 1 is a schematic top structural view of Embodiment 1 of a high-frequency radiator according to this application.

FIG. 1 is a schematic top structural view of Embodiment 1 of a high-frequency radiator according to this application. As shown in FIG. 1, the high-frequency radiator in this embodiment is a dual-polarized radiator, and the dual-polarized radiator includes one plus 45-degree single-polarized radiator 10 and one minus 45-degree single-polarized radiator 20. The single-polarized radiator 10 and the single-polarized radiator 20 are in a crisscross pattern. The two single-polarized radiators have a same structure. Herein, the single-polarized radiator 10 is used as an example for description.

Figure 2:
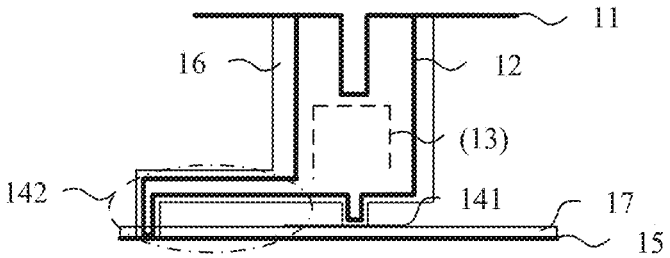
FIG. 2 is a schematic side structural view of Embodiment 1 of the high-frequency radiator according to this application.

FIG. 2 is a schematic side structural view of Embodiment 1 of the high-frequency radiator according to this application. As shown in FIG. 2, the single-polarized radiator 10 includes a radiation arm 11, a balun 12, a feeder circuit 13, a filter, and a ground plane 15. The radiation arm 11 and the balun 12 are electrically connected. The feeder circuit 13 (represented by a dashed line) and the balun 12 are separately disposed on two surfaces of a first dielectric plate 16 that is placed vertically. The ground plane 15 is disposed on a downward surface of a second dielectric plate 17 that is placed horizontally. The first dielectric plate 16 is vertically disposed on the second dielectric plate 17. The filter includes a capacitor branch 141 and an inductor branch 142. The inductor branch 142 is disposed on a same surface of the first dielectric plate 16 as the balun 12. The inductor branch 142 is separately electrically connected to the balun 12 and the ground plane 15. The capacitor branch 141 is disposed on an upward surface of the second dielectric plate 17. The capacitor branch 141 is electrically connected to the balun 12, and is coupled to the ground plane 15. The feeder circuit 13 is configured to feed the high-frequency radiator 10. The filter is configured to weaken an impact of the high-frequency radiator on a low-frequency radiator, where a highest frequency of an operating frequency band of the low-frequency radiator is lower than a lowest frequency of an operating frequency band of the high-frequency radiator. The dielectric plate in this application may be a printed circuit board (PCB), or may be a dielectric plate obtained by using a new process of plastic electroplating. This is not limited.

Figure 3:
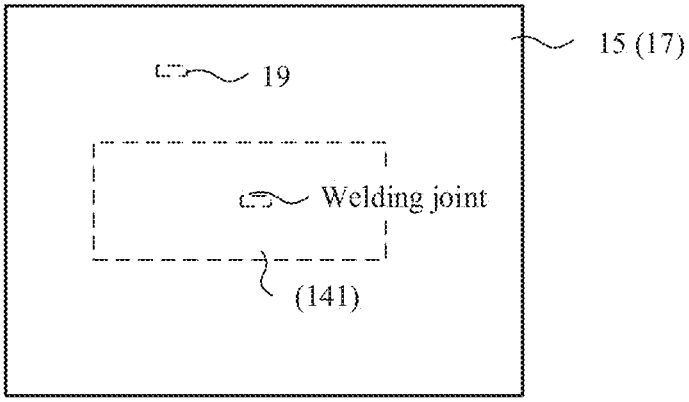
FIG. 3 is a schematic bottom structural view of Embodiment 1 of the high-frequency radiator according to this application.

FIG. 3 is a schematic bottom structural view of Embodiment 1 of the high-frequency radiator according to this application. As shown in FIG. 3, the capacitor branch 141

(represented by a dashed line) and the ground plane 15 are separately disposed on the two surfaces of the second dielectric plate 17, the ground plane 15 is on the downward surface of the second dielectric plate 17, and the capacitor branch 141 is on the upward surface of the second dielectric plate 17. To implement an electrical connection between the inductor branch 142 and the ground plane 15, there is a hole 19 that corresponds to the inductor branch 142 and that is on the second dielectric plate 17, so that the inductor branch 142 can pass through the hole 19 vertically and then be welded to the ground plane 15. To implement an electrical connection between the capacitor branch 141 and the balun 12, a position that is of the balun 12 and that corresponds to the capacitor branch 141 is welded to the second dielectric plate 17, and a welding joint of the capacitor branch 141 and the balun 12 is within coverage of the capacitor branch 141.

Figure 4:
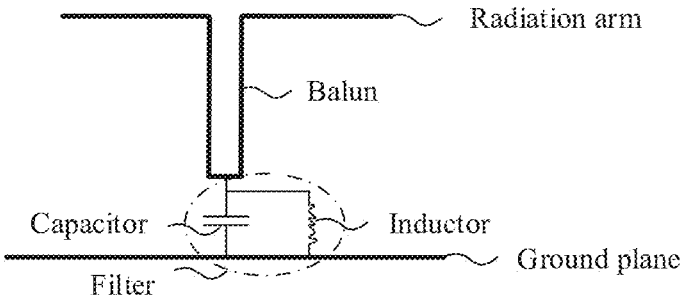
FIG. 4 is a schematic logical diagram of Embodiment 1 of the high-frequency radiator according to this application.

FIG. 4 is a schematic logical diagram of Embodiment 1 of the high-frequency radiator according to this application. As shown in FIG. 4, in this application, a filter is added between a balun and a ground plane of the high-frequency radiator. The filter can weaken an impact of the high-frequency radiator on a low-frequency radiator. The filter may be of a parallel or hybrid structure, where one branch includes one capacitor that plays a major role, and another branch includes one inductor that plays a major role. Such a filter structure can suppress, at the high-frequency radiator, common-mode resonance caused by a low-frequency signal when the low-frequency radiator transmits a signal. Good improvement can be achieved within a low frequency band (690 MHz to 960 MHz), provided that a combination of the capacitor and the inductor is adjusted. Based on this principle, in this application, a narrow and long metal stub line is equivalent to an inductor (e.g., an inductor branch), and a wide and short metal stub line is equivalent to a capacitor (e.g., a capacitor branch). In this embodiment, the inductor branch is directly electrically connected to the balun, and it may be considered that the inductor branch is integrated on the high-frequency radiator (a single-polarized radiator). The capacitor branch is a metal stub line disposed on an upward surface of a second dielectric plate, is close to the ground plane, and has a coupling area with the ground plane. Therefore, there is a capacitive effect between the capacitor branch and the ground plane, thereby implementing a coupling connection. When a capacitance value is appropriate, a signal can be transmitted between the capacitor branch and the ground plane.

In this application, when structures of a radiation arm and the balun of the high-frequency radiator are not affected, the filter is added between the balun and the ground plane, to weaken the impact of the high-frequency radiator on the low-frequency radiator, and implement normal transmission of a signal of the high-frequency radiator. This not only resolves a problem of common-mode resonance of the high-frequency radiator, but also ensures that a bandwidth of an antenna is not affected, and processing costs are low.

Figure 5:
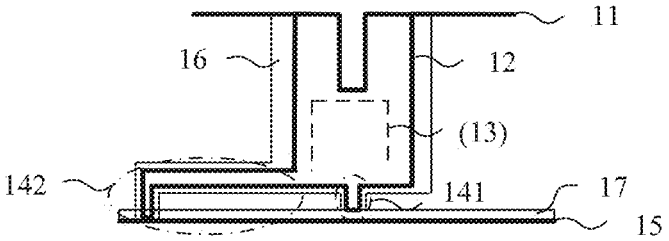
FIG. 5 is a schematic side structural view of Embodiment 2 of a high-frequency radiator according to this application.

On the basis of the embodiment shown in FIG. 2 to FIG. 4, FIG. 5 is a schematic side structural view of Embodiment 2 of a high-frequency radiator according to this application. As shown in FIG. 5, in this embodiment, a capacitor branch 141 is disposed on a same surface of a first dielectric plate 16 as a balun 12, and the capacitor branch 141 is electrically connected to the balun 12. To be specific, two layers of metal sheets under the balun 12 form the capacitor branch 141 of a filter. The capacitor branch 141 is welded to an upward surface of a second dielectric plate 17, may be close to a ground plane 15, and has a coupling area with the ground plane 15. Therefore, there is a capacitive effect between the capacitor branch 141 and the ground plane 15, thereby implementing a coupling connection.

In this application, when structures of a radiation arm and the balun 12 of the high-frequency radiator are not affected, the filter is added between the balun 12 and the ground plane 15, to weaken an impact of the high-frequency radiator on a low-frequency radiator, and implement normal transmission of a signal of the high-frequency radiator. This not only resolves a problem of common-mode resonance of the high-frequency radiator, but also ensures that a bandwidth of an antenna is not affected, and processing costs are low.

Figure 6:
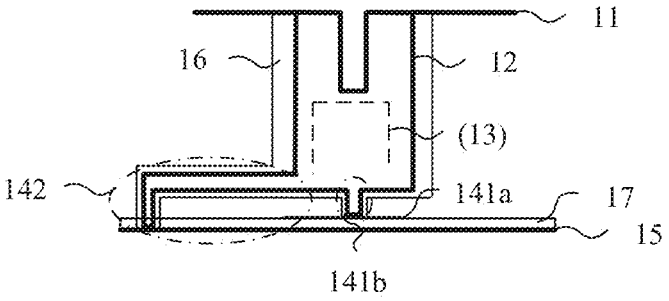
FIG. 6 is a schematic side structural view of Embodiment 3 of a high-frequency radiator according to this application.

FIG. 6 is a schematic side structural view of Embodiment 3 of a high-frequency radiator according to this application. As shown in FIG. 6, in this embodiment, a capacitor branch includes a first capacitor branch 141*a* and a second capacitor branch 141*b*, the first capacitor branch 141*a* is disposed on an upward surface of a second dielectric plate 17, the second capacitor branch 141*b* is disposed on a same surface of a first dielectric plate 16 as a balun 12, the second capacitor branch 141*b* is electrically connected to the balun 12, and the first capacitor branch 141*a* is electrically connected to the second capacitor branch 141*b*.

Figure 7:
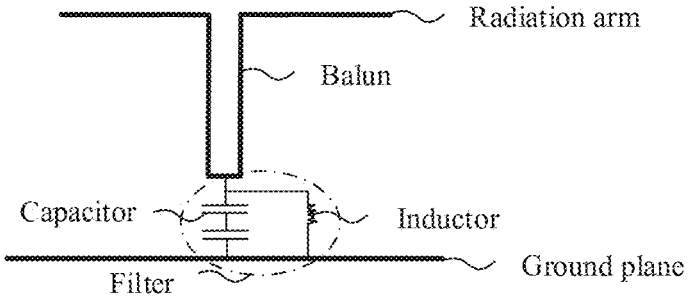
FIG. 7 is a schematic logical diagram of Embodiment 3 of the high-frequency radiator according to this application.

FIG. 7 is a schematic logical diagram of Embodiment 3 of the high-frequency radiator according to this application. As shown in FIG. 7, in this application, a filter is added between a balun and a ground plane of the high-frequency radiator, where one branch includes two capacitors that play a major role, and another branch includes one inductor that plays a major role. The filter can weaken an impact of the high-frequency radiator on a low-frequency radiator, and can suppress, at the high-frequency radiator, common-mode resonance caused by a low-frequency signal when the low-frequency radiator transmits a signal. In this embodiment, a second capacitor branch includes two layers of metal sheets under the balun, and a first capacitor branch is a metal stub line disposed on an upward surface of a second dielectric plate.

In this application, when structures of a radiation arm and the balun of the high-frequency radiator are not affected, the filter is added between the balun and the ground plane, to weaken the impact of the high-frequency radiator on the low-frequency radiator, and implement normal transmission of a signal of the high-frequency radiator. This not only resolves a problem of common-mode resonance of the high-frequency radiator, but also ensures that a bandwidth of an antenna is not affected, and processing costs are low.

Figure 8:
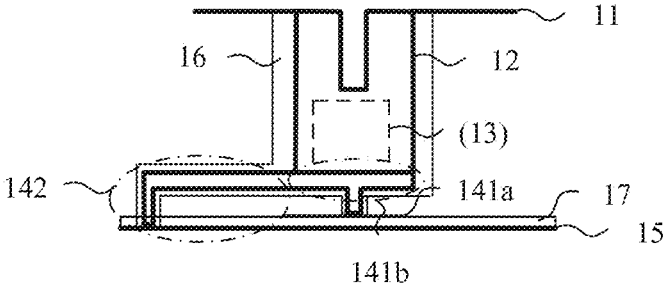
FIG. 8 is a schematic side structural view of Embodiment 4 of a high-frequency radiator according to this application.

FIG. 8 is a schematic side structural view of Embodiment 4 of a high-frequency radiator according to this application. As shown in FIG. 8, in this embodiment, a capacitor branch 141 includes a first capacitor branch 141*a* and a second capacitor branch 141*b*, the first capacitor branch 141*a* is disposed on an upward surface of a second dielectric plate 17, the second capacitor branch 141*b* is disposed on a same surface of a first dielectric plate 16 as a balun 12, an inductor branch 142 is electrically connected to the second capacitor branch 141*b*, and the first capacitor branch 11*a* is electrically connected to the second capacitor branch 141*b*.

Figure 9:
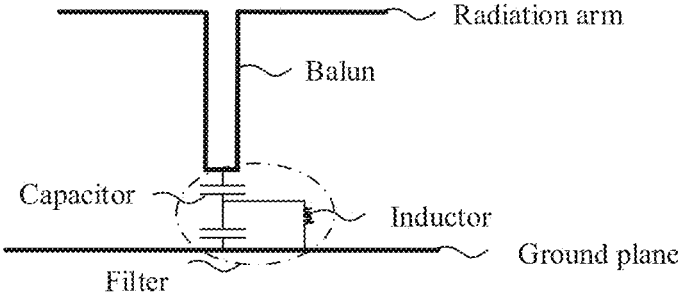
FIG. 9 is a schematic logical diagram of Embodiment 4 of the high-frequency radiator according to this application.

FIG. 9 is a schematic logical diagram of Embodiment 4 of the high-frequency radiator according to this application. As shown in FIG. 9, in this application, a filter is added between a balun and a ground plane of the high-frequency radiator, where one branch includes one capacitor that plays a major role, another branch includes one inductor that plays a major role, and the two branches are then connected to a capacitor in series. The filter can weaken an impact of the high-frequency radiator on a low-frequency radiator, and can suppress, at the high-frequency radiator, common-mode resonance caused by a low-frequency signal when the low-frequency radiator transmits a signal. In this embodiment, an inductor branch 142 is directly electrically connected to a second capacitor branch 141*b*, the second capacitor branch 141*b* includes two layers of metal sheets under the balun 12, and a first capacitor branch 141*a* is a metal stub line disposed on an upward surface of a second dielectric plate 17.

In this application, when structures of a radiation arm and the balun of the high-frequency radiator are not affected, the filter is added between the balun and the ground plane, to weaken the impact of the high-frequency radiator on the low-frequency radiator, and implement normal transmission of a signal of the high-frequency radiator. This not only resolves a problem of common-mode resonance of the high-frequency radiator, but also ensures that a bandwidth of an antenna is not affected, and processing costs are low.

Figure 10:
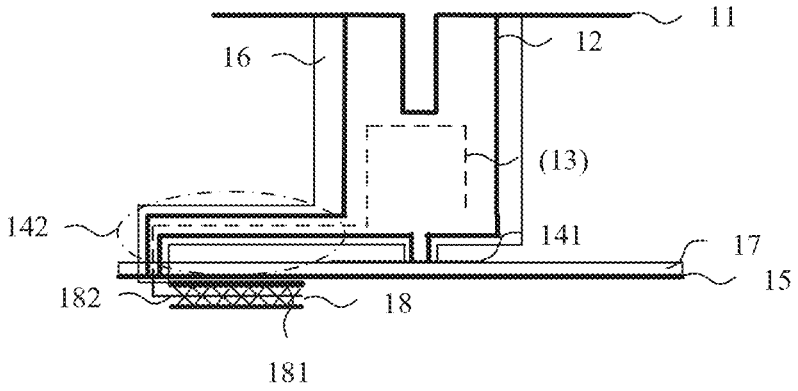
FIG. 10 is a schematic side structural view of Embodiment 5 of a high-frequency radiator according to this application.

FIG. 10 is a schematic side structural view of Embodiment 5 of a high-frequency radiator according to this application. As shown in FIG. 10, on the basis of any of the embodiments in FIG. 1 to FIG. 9, an inductor branch 142 is used as a ground plane 15, a feeder circuit 13 and the inductor branch 142 form a microstrip line structure, and a coaxial line 18 is disposed on a downward surface of a second dielectric plate 17, an outer conductor 181 of the coaxial line 18 is electrically connected to the ground plane 15, and an inner conductor 182 of the coaxial line 18 is electrically connected to the feeder circuit 13.

Figure 11:
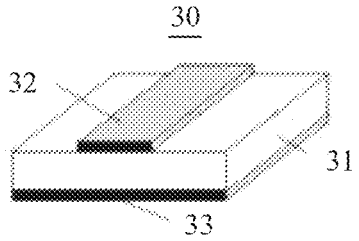
FIG. 11 is a schematic diagram of a microstrip line structure of Embodiment 5 of the high-frequency radiator according to this application.

FIG. 11 is a schematic diagram of a microstrip line structure of Embodiment 5 of the high-frequency radiator according to this application. As shown in FIG. 11, the microstrip line structure 30 includes a conductor strip 32 and a ground plane 33 that are located on two sides of a dielectric substrate 31. In this application, the feeder circuit 13 (equivalent to the conductor strip 32), the inductor branch 142 (equivalent to the ground plane 33), and a first dielectric plate 16 between the feeder circuit 13 and the inductor branch 142 are used to form the microstrip line structure 30. In this way, a high-frequency current signal transmitted from the coaxial line 18 may flow to the feeder circuit 13 and the balun 12 without loss from the inner conductor 182, and the outer conductor 181 and the ground plane 15 are directly electrically connected through welding, which implements a complete feeding system of the entire high-frequency radiator. In addition, a standing wave bandwidth is higher, and there is no signal discontinuity.

Figure 12:
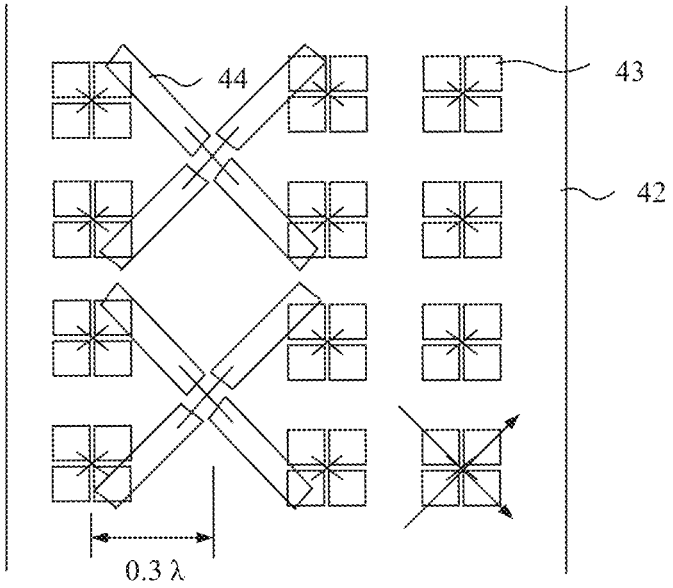
FIG. 12 is a schematic structural diagram of an embodiment of a multi-frequency array antenna according to this application.

FIG. 12 is a schematic structural diagram of an embodiment of a multi-frequency array antenna according to this application. As shown in FIG. 12, the multi-frequency array antenna includes an antenna radiator 41 and an antenna reflection plate 42. The antenna radiator 41 is disposed on the antenna reflection plate 42. The antenna radiator 41 includes at least one high-frequency radiator 43 and at least one low-frequency radiator 44. The at least one high-frequency radiator 43 forms three high-frequency arrays, and the at least one low-frequency radiator 44 forms one low-frequency array. The high-frequency arrays and the low-frequency array are arranged crosswise in a horizontal direction. A highest frequency of an operating frequency band of the low-frequency radiator 44 is lower than a lowest frequency of an operating frequency band of the high-frequency radiator 43. The high-frequency radiator in any of the embodiments in FIG. 1 to FIG. 11 is used as the high-frequency radiator 43. A distance between the high-frequency radiator 43 and the low-frequency radiator 44 is less than or equal to 0.4λ (for example, 0.3λ), where λ is a wavelength corresponding to a center frequency of the operating frequency band of the low-frequency radiator 44.

According to the multi-frequency array antenna in this application, when structures of a radiation arm and a balun of the high-frequency radiator are not affected, a filter is added between the balun and a ground plane, to weaken an impact of the high-frequency radiator on the low-frequency radiator, and implement normal transmission of a signal of the high-frequency radiator. This not only resolves a problem of common-mode resonance of the high-frequency radiator, but also ensures that a bandwidth of the antenna is not affected, and processing costs are low.

In a possible implementation, this application provides a base station. The base station includes a multi-frequency array antenna, and the multi-frequency array antenna in the embodiment shown in FIG. 12 is used as the multi-frequency array antenna. A wireless network structure in which the base station is located includes a mobile terminal, a base station, a network switching access interface, and an operation management center. The base station includes a multi-frequency array antenna, a radio frequency front module, and a baseband signal processing module. The multi-frequency array antenna is a connective device between a mobile user terminal and the radio frequency front module, and is mainly configured to perform cell coverage of a wireless signal. The multi-frequency array antenna includes several arrays that include radiators operating at different frequencies. The arrays receive or transmit radio frequency signals through respective feeding networks.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A high-frequency radiator, comprising:

two plus and minus 45-degree single-polarized radiators, wherein the high-frequency radiator is a dual-polarized radiator, wherein each single-polarized radiator of the two plus and minus 45-degree single-polarized radiators comprises a radiation arm, a balun, a feeder circuit, a filter, and a ground plane, wherein the radiation arm and the balun are electrically connected, the feeder circuit and the balun are separately disposed on two surfaces of a first dielectric plate that is placed vertically, the ground plane is disposed on a downward surface of a second dielectric plate that is placed horizontally, the first dielectric plate is vertically disposed on the second dielectric plate, and the filter comprises a capacitor branch and an inductor branch, wherein the inductor branch is disposed on a same surface of the first dielectric plate as the balun, the inductor branch is separately electrically connected to the balun and the ground plane, and the capacitor branch is coupled to the ground plane, wherein the feeder circuit is configured to feed the high-frequency radiator, and wherein the filter is configured to weaken an impact of the high-frequency radiator on a low-frequency radiator, wherein a highest frequency of an operating frequency band of the low-frequency radiator is lower than a lowest frequency of an operating frequency band of the high-frequency radiator.

2. The high-frequency radiator according to claim 1, wherein the capacitor branch is disposed on an upward surface of the second dielectric plate, and the capacitor branch is electrically connected to the balun.

3. The high-frequency radiator according to claim 1, wherein the capacitor branch is disposed on the same surface of the first dielectric plate as the balun, and the capacitor branch is electrically connected to the balun.

4. The high-frequency radiator according to claim 1, wherein the capacitor branch comprises a first capacitor branch and a second capacitor branch, the first capacitor branch is disposed on an upward surface of the second dielectric plate, the second capacitor branch is disposed on the same surface of the first dielectric plate as the balun, the second capacitor branch is electrically connected to the balun, and the first capacitor branch is electrically connected to the second capacitor branch.

5. The high-frequency radiator according to claim 1, wherein the capacitor branch comprises a first capacitor branch and a second capacitor branch, the first capacitor branch is disposed on an upward surface of the second dielectric plate, the second capacitor branch is disposed on the same surface of the first dielectric plate as the balun, the inductor branch is electrically connected to the second capacitor branch, and the first capacitor branch is electrically connected to the second capacitor branch.

6. The high-frequency radiator according to claim 1, wherein the inductor branch is used as the ground plane, the feeder circuit and the inductor branch form a microstrip line structure, a coaxial line is disposed on the downward surface of the second dielectric plate, an outer conductor of the coaxial line is electrically connected to the ground plane, and an inner conductor of the coaxial line is electrically connected to the feeder circuit.

7. The high-frequency radiator according to claim 1, wherein both the inductor branch and the capacitor branch are metal stub lines, and a contour formed by a metal stub line used as the inductor branch is narrower and longer than a contour formed by a metal stub line used as the capacitor branch.

8. A multi-frequency array antenna, comprising:

an antenna radiator, and an antenna reflection plate, wherein the antenna radiator is disposed on the antenna reflection plate, the antenna radiator comprises a high-frequency radiator and a low-frequency radiator, the high-frequency radiator and the low-frequency radiator are arranged crosswise in a horizontal direction, and a highest frequency of an operating frequency band of the low-frequency radiator is lower than a lowest frequency of an operating frequency band of the high-frequency radiator, wherein the high-frequency radiator includes two plus and minus 45-degree single-polarized radiators, wherein the high-frequency radiator is a dual-polarized radiator, wherein each single-polarized radiator of the two plus and minus 45-degree single-polarized radiators comprises a radiation arm, a balun, a feeder circuit, a filter, and a ground plane, wherein the radiation arm and the balun are electrically connected, the feeder circuit and the balun are separately disposed on two surfaces of a first dielectric plate that is placed vertically, the ground plane is disposed on a downward surface of a second dielectric plate that is placed horizontally, the first dielectric plate is vertically disposed on the second dielectric plate, and the filter comprises a capacitor branch and an inductor branch, wherein the inductor branch is disposed on a same surface of the first dielectric plate as the balun, the inductor branch is separately electrically connected to the balun and the ground plane, and the capacitor branch is coupled to the ground plane, wherein the feeder circuit is configured to feed the high-frequency radiator, and wherein the filter is configured to weaken an impact of the high-frequency radiator on the low-frequency radiator.

9. The multi-frequency array antenna according to claim 8, wherein a distance between the high-frequency radiator and the low-frequency radiator is less than or equal to $0.4\lambda$, and wherein $\lambda$ is a wavelength corresponding to a center frequency of the operating frequency band of the low-frequency radiator.

10. The multi-frequency array antenna according to claim 8, wherein the capacitor branch is disposed on an upward surface of the second dielectric plate, and the capacitor branch is electrically connected to the balun.

11. The multi-frequency array antenna according to claim 8, wherein the capacitor branch is disposed on the same surface of the first dielectric plate as the balun, and the capacitor branch is electrically connected to the balun.

12. The multi-frequency array antenna according to claim 8, wherein the capacitor branch comprises a first capacitor branch and a second capacitor branch, the first capacitor branch is disposed on an upward surface of the second dielectric plate, the second capacitor branch is disposed on the same surface of the first dielectric plate as the balun, the second capacitor branch is electrically connected to the balun, and the first capacitor branch is electrically connected to the second capacitor branch.

13. The multi-frequency array antenna according to claim 8, wherein the capacitor branch comprises a first capacitor branch and a second capacitor branch, the first capacitor branch is disposed on an upward surface of the second dielectric plate, the second capacitor branch is disposed on the same surface of the first dielectric plate as the balun, the inductor branch is electrically connected to the second capacitor branch, and the first capacitor branch is electrically connected to the second capacitor branch.

14. The multi-frequency array antenna according to claim 8, wherein the inductor branch is used as the ground plane, the feeder circuit and the inductor branch form a microstrip line structure, a coaxial line is disposed on the downward surface of the second dielectric plate, an outer conductor of the coaxial line is electrically connected to the ground plane, and an inner conductor of the coaxial line is electrically connected to the feeder circuit.

15. The multi-frequency array antenna according to claim 8, wherein both the inductor branch and the capacitor branch are metal stub lines, and a contour formed by a metal stub line used as the inductor branch is narrower and longer than a contour formed by a metal stub line used as the capacitor branch.

16. Abase station, comprising:

a multi-frequency array antenna including an antenna radiator and an antenna reflection plate, wherein the antenna radiator is disposed on the antenna reflection plate, the antenna radiator comprises a high-frequency radiator and a low-frequency radiator, the high-frequency radiator and the low-frequency radiator are arranged crosswise in a horizontal direction, and a highest frequency of an operating frequency band of the low-frequency radiator is lower than a lowest frequency of an operating frequency band of the high-frequency radiator, wherein the high-frequency radiator includes two plus and minus 45-degree single-polarized radiators, wherein the high-frequency radiator is a dual-polarized radiator, wherein each single-polarized radiator of the two plus and minus 45-degree single-polarized radiators comprises a radiation arm, a balun, a feeder circuit, a filter, and a ground plane, wherein the radiation arm and the balun are electrically connected, the feeder circuit and the balun are separately disposed on two surfaces of a first dielectric plate that is placed vertically, the ground plane is disposed on a downward surface of a second dielectric plate that is placed horizontally, the first dielectric plate is vertically disposed on the second dielectric plate, and the filter comprises a capacitor branch and an inductor branch, wherein the inductor branch is disposed on a same surface of the first dielectric plate as the balun, the inductor branch is separately electrically connected to the balun and the ground plane, and the capacitor branch is coupled to the ground plane, wherein the feeder circuit is configured to feed the high-frequency radiator, and wherein the filter is configured to weaken an impact of the high-frequency radiator on the low-frequency radiator.

17. The base station according to claim 16, wherein a distance between the high-frequency radiator and the low-frequency radiator is less than or equal to 0.4λ, and wherein λ is a wavelength corresponding to a center frequency of the operating frequency band of the low-frequency radiator.

18. The base station according to claim 16, wherein the capacitor branch is disposed on an upward surface of the second dielectric plate, and the capacitor branch is electrically connected to the balun.

19. The base station according to claim 16, wherein the capacitor branch is disposed on the same surface of the first dielectric plate as the balun, and the capacitor branch is electrically connected to the balun.

20. The base station according to claim 16, wherein the capacitor branch comprises a first capacitor branch and a second capacitor branch, the first capacitor branch is disposed on an upward surface of the second dielectric plate, the second capacitor branch is disposed on the same surface of the first dielectric plate as the balun, the second capacitor branch is electrically connected to the balun, and the first capacitor branch is electrically connected to the second capacitor branch.

* * * * *